United States Patent [19]

Hantschk

[11] Patent Number: 4,695,040

[45] Date of Patent: Sep. 22, 1987

[54] ERECTING RIG FOR A WELL PUMP

[75] Inventor: Günther Hantschk, Waldkraiburg, Fed. Rep. of Germany

[73] Assignee: Netzsch-Mohnopumpen GmbH, Waldkraiburg, Fed. Rep. of Germany

[21] Appl. No.: 873,100

[22] Filed: Jun. 4, 1986

Related U.S. Application Data

[63] Continuation of Ser. No. 658,709, Oct. 9, 1984, abandoned.

[30] Foreign Application Priority Data

Oct. 17, 1983 [DE] Fed. Rep. of Germany ..... 3337698

[51] Int. Cl.[4] ..... B66D 3/14

[52] U.S. Cl. ..... 254/264; 166/98; 254/334; 254/390

[58] Field of Search ..... 166/98; 254/334, 335, 254/336, 337, 338, 390, 263, 264

[56] References Cited

U.S. PATENT DOCUMENTS

| | | | |
|---|---|---|---|
| 783,672 | 2/1905 | Bock | 254/338 |
| 789,501 | 5/1905 | Lihou et al. | 254/338 |
| 807,861 | 12/1905 | Pennell | 254/334 |
| 2,779,569 | 1/1957 | Gills | 254/334 |
| 3,103,344 | 9/1963 | Figge | 254/338 |
| 3,991,978 | 11/1976 | Jones | 254/335 |

*Primary Examiner*—Billy S. Taylor
*Attorney, Agent, or Firm*—Browdy and Neimark

[57] ABSTRACT

A well pump includes a string of risers composed of a plurality of releasably coupled risers, a hollow upright, and a drive mechanism releasably mounted on the upright. The corresponding erecting rig consists of a mast adapted to be supported by the upright, a deflecting device arranged at the upper end of the mast, and a pulling element passing around the deflecting device and formed at its one end for suspension of a riser and at its other end for suspension of a lifting device. The erecting rig is much lighter in weight and simpler and, therefore, may be transported and assembled more easily than lifting tackle used so far of the same lifting height and capacity.

9 Claims, 2 Drawing Figures

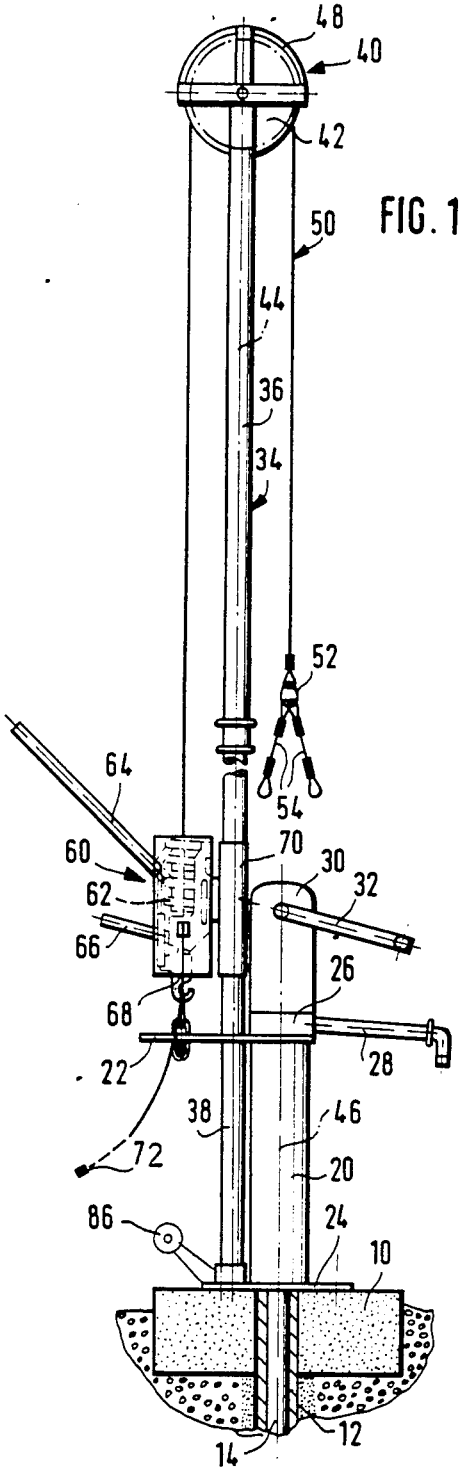
FIG. 1
FIG. 2
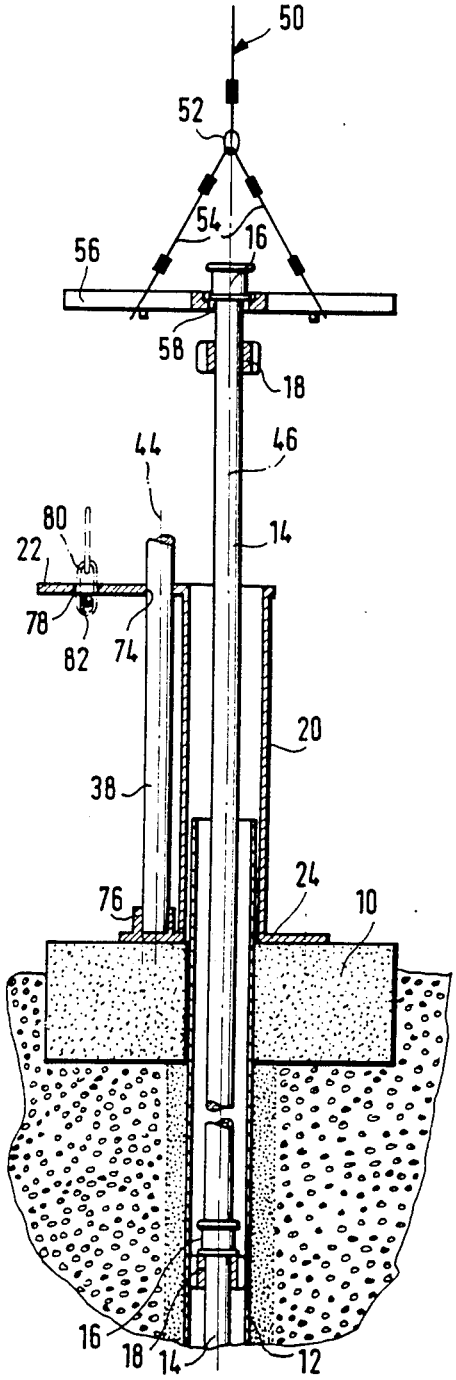

ERECTING RIG FOR A WELL PUMP

This application is a continuation of application Ser. No. 658,709, filed Oct. 9, 1984, now abandoned.

The invention relates to an erecting rig for a well pump which comprises a string of several releasably coupled risers, a hollow upright, and a drive mechanism releasably mounted on the upright.

Well pumps are widely used as a means of water supply for people who live in the country in developing nations and dry zones around the globe. Usually they are actuated by the force of muscle and they convey underground water up from depths of as much as 100 m. The locations where well pumps are erected normally are far out in the open country and can be reached only by vehicles suitable for cross-country driving.

Heavy hoisting tackle must be transported to the site of such well pumps so far if they are to be erected, serviced, or repaired. This requires an organization which will plan and send the necessary groups of assembly workers and equipment to the various sites, for all of which a lot of money is needed. Often this is not available and consequently in many cases the necessary service and repair work on well pumps remains undone.

It is, therefore, an object of the invention to develop a simple, light, and inexpensive device, preferably for supply together with each well pump or group of pumps and to remain at or near the place of erection, preferably under the supervision of a person responsible for pump operations who should be able, without any special training, to erect the device at the well pump, if required, and thereby at least prepare the necessary maintenance or repair work.

This object is met, in accordance with the invention, by an erecting rig comprising a mast adapted to be supported by the upright, a deflecting device arranged at the upper end of the mast, and a pulling element passing around the deflecting device and designed at one end for suspension of a riser and at the other end for suspension of a lifting device.

An erecting rig according to the invention for a certain lifting capacity may be constructed to be much lighter in weight and simpler in design so that it can be shipped and erected more easily than any hoisting tackle used so far for comparable purposes and of the same lifting height and capacity. If the terrain is not too forbidding, a man of average vigor will be able to carry the entire erecting rig according to the invention and walk over rather long distances, or he may transport it on a bicycle. Under the respective circumstances, therefore, a single erecting rig may be used for several well pumps if they are not too far apart.

The necessary stability of the erecting rig at the place of assembly is afforded because the mast is supported by the upright of the pump. The upright in any case is made sufficiently strong because of the load occuring during operation of the pump. Consequently it can withstand also those loads which may occur when the erecting rig according to the invention is mounted and used.

The lifting device, for instance, may be a rope or cable winch or a chain winch or any hoist-draw gear of conventional design operating with intermittent wire clamping. If the well pumps are not too deep and the string of risers is correspondingly light, an additional rope may be provided as the lifting device which is passed around at least one additional deflecting device to be anchored at the upright and which is then pulled by muscle power.

Preferably at least an upper part of the mast is connected undetachably to the deflecting device, pulling element, and lifting device. Misuse and loss of the individual parts of the erecting rig are thereby avoided. The undetachable connection may be made simply by fittings which cannot be removed at both ends of the pulling element which is passed through the lifting and deflecting devices.

Moreover, it is convenient if the lifting device comprises a hook-up device which can be anchored in such manner at the upright that the pulling element enters the lifting device at a location diametrically opposed to the axis of the upright with reference to the mast axis. In this manner bending torques occurring during the use of the erecting rig according to the invention largely are kept off the mast which substantially is loaded under pressure only so that it may be given its slender and light configuration.

If the lifting device is embodied by a hoist-draw gear, preferably it comprises an additional guide means by which it is guided for vertical displacement along the mast. This provides additional stabilization for the lifting device which is anchored at the upright and thus cannot swing like a pendulum. That would make its handling more difficult and disturb the symmetry of the pulling element with respect to the mast axis.

The mast preferably is held in a head member and a foot member both fixed or adapted to be fixed to the top and bottom ends, respectively, of the upright.

The head member, for instance, is a plate formed with an opening for insertion of the mast and including another fixing place for anchoring the lifting device.

The deflecting device preferably comprises a guide pulley the radius of which corresponds at least approximately to the distance between the axes of mast and upright. Thereby the mast may be kept almost entirely free of bending loads at any desired position of the pulling element.

Transportation of the erecting rig according to the invention may be facilitated by dividing the mast into an upper part to which the deflecting device is attached and a lower part in the form of a riser. When a well pump is installed, usually at least one riser is left over and may be used as a component part of the mast.

Finally, it is advantageous if the pulling element includes a crowfoot at its one end associated with the upright. The drive mechanism or a yoke for lifting the string of risers selectively may be suspended from the crowfoot.

The invention will be described further, by way of example, with reference to the accompanying drawings, in which:

FIG. 1 is a lateral elevation, partly in vertical section, of the parts of a well pump close to the ground and above the ground and of an erecting rig according to the invention, and FIG. 2 is an enlarged vertical sectional view of details shown in FIG. 1.

The well pump has a concrete foundation 10 from which a casing 12 extends down in vertical direction to the waterbearing layer of the ground. The casing 12 is laterally spaced around a string of risers 14 which it encloses and which is composed of risers 14 coupled together by pipe couplings 16 and centered in the casing 12 by star-like support rings 18.

An upright 20 rests on the foundation 10, being screw-connected to the same by a plate-shaped foot member 24. The upright 20 also has a unilaterally projecting, plate-shaped head member 22 on which an intermediate housing 26 is fixed. The housing comprises a water outlet 28 and carries a drive mechanism 30.

In the embodiment shown the drive mechanism 30 is a gearing adapted to be driven by a hand crank 32 in order to drive a shaft strand (not shown) which extends downwardly through the string of risers and is coupled to a worm-like rotor. The rotor operates in a worm-like stator disposed in the lower end range of the casing 12 and adapted to be pulled out through the casing together with the risers 14.

This design of a well pump is known from DE 31 32 260 Al so that it need not be illustrated and described in detail here, all the more so as a well pump embodied by an eccentric worm gear pump is not of specific importance in the present context. The well pump, for example, also may be a cylinder pump. In this case the drive mechanism is so designed that it converts the rotation of a hand crank or the swinging of a pump handle into reciprocating up and down movements of a plunger. Pumps of this kind are known from the journal "World Water" of February 1983, for instance.

An erecting rig including a slender tubular mast 34 is cooordinated with the pump, the mast is composed of an upper part 36 and a lower part 38. The lower part 38 is fully identical with an excess riser 14, including the associated pipe coupling. The overall height of the mast 34 is greater at least by the height of the upright 20, than the length of each individual riser 14 with its coupling 16.

A deflecting device 40 is arranged at the upper end of the upper part 36. It comprises a guide pulley 42 whose axis of rotation intersects the mast axis 44 and extends at right angles with respect to the vertical plane containing the axis 46 of the upright and the mast axis 44 in parallel with the same, when in assembled condition as shown. The guide pulley 42 has a radius of deflection which corresponds to the distance between the two axes 44 and 46. The upper half of the guide pulley 42 is covered by a protective hood 48.

A pulling element 50, a rope in the embodiment shown, passes around the guide pulley 42. A chain could be used instead. An annular fitting 52 is fastened to the one strand of the pulling element 50 hanging above the upright 20, and a yoke 56 is suspended from this end by way of a crowfoot 54. The yoke 56 is formed in the middle with a recess 58 which is open at the side and so dimensioned that the yoke 56 may grip one riser 14 after the other below its coupling 16 so as to withdraw the same from the casing 12 or lower it inside the casing 12. Instead of the yoke 56 the drive mechanism 30 may be suspended from the crowfoot 54 for assembly or disassembly, making use of two shaft ends, for example.

The other strand of the pulling element 50 passes through a lifting device 60 shown as a commercially available hoistdraw gear which comprises alternatingly operative clamping jaw pairs 62, and actuating lever 64, and a brake lever 66. The lifting device 60 includes a hook-up device 68 in the form of a hook and a tubular guide means 70 by means of which it is guided at the lower part 38 of the mast 34 for displacement in the longitudinal direction thereof. The pulling element 50 is passed downwardly or laterally out of the lifting device 60 and has another fitting 72 at its end.

The lower part 38 of the mast 34 is inserted from above through a circular opening 74 in the head member 22 of the upright 20 and engages in a sleeve-like mount 76 formed at the foot member 24. In this manner the entire mast 34 is connected rigidly to the upright 20 so that no further support is needed for the mast.

Another fixing place 78 embodied by a hole is provided in the head member 22. This hole lies on the same radius as the center of the opening 74 which determines the position of the axis 46 of the upright, starting from this axis 46. The distance between centers of the fixing place 78 and the axis 46 of the upright is twice as great as the spacing of the center of the opening 74 from the axis of the upright. A chain 80 passes through the hole of fixing place 78 and the hook-up device 68 is hooked to this chain and secured to the head member 22 of the upright 20 by a bolt 82.

If the lifting device is embodied by a rope or chain winch, the hook-up device 68 may comprise a rigid type of tie fixed to the lifting device and adapted to be slid laterally on the head member 22 so that the lifting device can be coupled rigidly to the upright 20 by the hook-up device and the head member 22.

In addition to the lifting device 60 as shown, an additional rope not shown may be linked to the pulling element 50 and passes around at least one additional guide pulley 86 anchored at the upright 20. If desired, it may form a tackle block together with a number of similar guide pulleys, thus presenting another lifting device which is operable by muscular power.

What is claimed is:

1. An erecting rig for a well pump having a string of several releasably coupled risers comprising a hollow upright;

a head member and a foot member fixed to top and bottom ends, respectively, of the upright;

a mast supported by said upright;

guide pulley means arranged at an upper end of said mast and having a radius which corresponds substantially to the distance between the axes of said mast and said upright, the distance determined by said head member and said foot member;

a pulling element passing around said pulley means and said pulling element including connected elements extended downward from said pulley means in parallel lines to each other with said pulling element at one end having means for suspension of a riser and at the other end having a connecting means for a lifting device;

said foot member being a ground engaging member;

said mast having its bottom abutted against said foot member.

2. The erecting rig for a well pump of claim 1, further comprising said foot member having a supporting socket means to receive and support said mast.

3. The erecting rig for a well pump of claim 1, further comprising said mast being a monopode.

4. The erecting rig for a well pump of claim 1, further comprising said guide pulley means having a diameter to extend said pulling element connected elements along the axis of a riser and of a connecting means for a lifting device to prevent lateral and bending forces on said mast.

5. The erecting rig for a well pump of claim 1, further comprising said guide pulley means having a radius measured from the axis of said mast equal to the distance to an axis of a riser positioned parallel to the axis of said mast during lifting movement of the riser to prevent a component forcing a riser against walls of said upright.

6. The erecting rig for a well pump of claim 1, further comprising said connecting means for a lifting device including means for anchoring said head member on a said parallel line of a said connected element of said pulling element.

7. The erecting rig for a well pump of claim 6, further comprising a lifting device attached on said connecting means for a lifting device and having guide means attached to said lifting device to guide said lifting device for vertical displacment along said mast.

8. The erecting rig for a well pump of claim 1, further comprising slab support means beneath said ground engaging member to provide an additional solid support surface for said upright.

9. The erecting rig for a well pump of claim 1, further comprising said pulling element at said end having means for suspension of a riser having a crowfoot with a yoke to lift a string of risers.

* * * * *